US006217748B1

(12) United States Patent
Hatanaka et al.

(10) Patent No.: US 6,217,748 B1
(45) Date of Patent: Apr. 17, 2001

(54) PROCESS FOR HYDRODESULFURIZATION OF DIESEL GAS OIL

(75) Inventors: Shigeto Hatanaka, Yokohama; Osamu Sadakane, Tokyo; Hideshi Iki, Yokohama, all of (JP)

(73) Assignee: Nippon Mitsubishi Oil Corp. (JP)

( * ) Notice: Subject to any disclaimer, the term of this patent is extended or adjusted under 35 U.S.C. 154(b) by 0 days.

(21) Appl. No.: 09/378,001

(22) Filed: Aug. 19, 1999

(30) Foreign Application Priority Data

Oct. 5, 1998 (JP) ..... 10-282924

(51) Int. Cl.[7] ..... C10G 65/02; C10G 45/02

(52) U.S. Cl. ..... 208/210; 208/211; 208/213; 208/218

(58) Field of Search ..... 208/210, 211, 208/213, 218

(56) References Cited

U.S. PATENT DOCUMENTS

| | | | | |
|---|---|---|---|---|
| 2,983,676 | * | 5/1961 | Howland | 208/218 |
| 3,179,586 | * | 4/1965 | Honerkamp | 208/216 R |
| 3,183,179 | * | 5/1965 | Schuman | 208/97 |
| 3,617,525 | * | 11/1971 | Moritz et al. | 208/211 |
| 3,617,526 | * | 11/1971 | Coons, Jr. et al. | 208/211 |
| 3,717,571 | * | 2/1973 | Schulman | 208/254 H |
| 3,830,731 | * | 8/1974 | Reed, Jr. et al. | 208/211 |
| 3,902,991 | * | 9/1975 | Christensen et al. | 208/211 |
| 3,963,604 | * | 6/1976 | Hutchings | 208/11 |
| 4,003,828 | | 1/1977 | Eberly | 208/251 H |
| 4,006,076 | * | 2/1977 | Christensen et al. | 208/211 |
| 4,170,546 | * | 10/1979 | Frayer et al. | 208/210 |
| 4,173,528 | * | 11/1979 | Frayer et al. | 208/210 |
| 4,755,280 | * | 7/1988 | Hudson et al. | 208/89 |
| 4,990,242 | * | 2/1991 | Louie et al. | 208/218 |
| 5,308,472 | * | 5/1994 | Dai et al. | 208/111.3 |
| 5,316,658 | | 5/1994 | Ushio et al. | 208/216 R |
| 5,409,599 | * | 4/1995 | Harandi et al. | 208/210 |

FOREIGN PATENT DOCUMENTS

| | | |
|---|---|---|
| 52-13503 | 2/1977 | (JP) . |
| 3-281596 | 12/1991 | (JP) . |
| 5-311179 | 11/1993 | (JP) . |
| 7-102266 | 4/1995 | (JP) . |
| 7-197039 | 8/1995 | (JP) . |

OTHER PUBLICATIONS

"Key Parameters in Deep Hydrodesulfurization of Diesel Fuel", F. van Looij, et al, Applied Catalysis A: General 170 (1998) 1–12.

"Catalysis Review", 24 (3), 343–345 (1982).

High Olefin Content May Limit Craked Naphtha Desulfurization, D.P. Satchell, "The Oil and Gas Journal", Dec. 1, 1975.

"Hydrodesulfurization of Catalytic Cracked Gasoline", S. Hatanaka and M. Yamada, "Industrial & Engineering Chemistry Research", vol. 36, No. 5, pp. 1519–1523 (1997).

"Hydrodesulfurization of Catalytic Cracked Gasoline", S. Hatanaka and M. Yamada, "Industrial & Engineering Chemistry Research", vol. 36, No. 12, pp. 5110–5117 (1997).

"Hydrodesulfurization of Catalytic Cracked Gasoline", S. Hatanaka and M. Yamada, "Industrial & Engineering Chemistry Research", vol.I 37, No. 5, pp. 1748–1754 (1998).

* cited by examiner

*Primary Examiner*—Walter D. Griffin
(74) *Attorney, Agent, or Firm*—Paul & Paul

(57) ABSTRACT

A process for hydrodesulfurization of a sulfur-containing petroleum hydrocarbon diesel gas oil comprising; hydrodesulfurizing a sulfur-containing petroleum hydrocarbon diesel gas oil feedstock, separating the hydrodesulfurized diesel gas oil feedstock into light and heavy fractions by distillation, hydrodesulfurizing further the separated heavy fraction, and mixing the further hydrodesulfurized heavy fraction and the separated light fraction into the hydrocarbon diesel gas oil.

13 Claims, No Drawings

PROCESS FOR HYDRODESULFURIZATION OF DIESEL GAS OIL

BACKGROUND OF THE INVENTION

1. Field of the Invention

The present invention relates to a process for hydrodesulfurization of sulfur-containing diesel gas oil, which comprises a specific combination of specific hydrogenation steps.

2. Description of Related Art

The straight run diesel gas oil obtained by distilling the crude oil or the cracked diesel gas oil obtained by cracking heavy oil contains sulfur compounds, and the amount of the compounds is in a range of 1 to 3 wt % as sulfur. When the diesel gas oil containing sulfur compounds is used as a diesel fuel, sulfur compounds will be exhausted into atmosphere as SOx and the environment will be polluted.

Therefore, these diesel gas oils are used as a fuel usually after being hydrodesulfurized to remove sulfur compounds. It is stated that the permissible value for the amount of sulfur included in a diesel fuel should be 0.05 wt % or less in JIS (Japanese Industrial Standard), and large-scale desulfurization arrangements have been constructed and used to achieve this value. In addition, it is said that it is necessary to decrease the amount of sulfur further with the view of installing a purification catalyst, which reduces NOx in an automotive exhaust gas, into a diesel car in the future, for using a part of the automotive exhaust gas again, by circulating it, as a part of a diesel fuel. This system is called as EGR system (EGR: Exhaust Gas Recirculation).

A catalyst which consists essentially of cobalt or nickel, and molybdenum, supported on a porous carrier containing alumina as a main ingredient, has conventionally been used for the desulfurization of diesel gas oil so far. However, the conventional catalysts have such problems in that they can hardly remove 4-methyldibenzothiophene and 4,6-dimethyldibenzothiophene, and it is necessary to raise the reaction temperature and the reaction pressure to a very high level in order to lower the sulfur content of the product to the level of 0.05 wt % or less, so that the construction costs of the arrangement and the drive costs increase.

As for a process for improving the desulfurization activity to sulfur compounds, a catalyst whose carrier contains phosphorous and boron has been reported in Japanese Unexamined Patent Publication (Kokai) No. 52-13503, as well as a catalyst to whose carrier zeolite is added, has been reported in Japanese Unexamined Publication (Kokai) No. 7-197039. These catalysts have Brønsted acid sites and, thus, exhibit high ability to isomerize a methyl group of dimethyldibenzothiophene and to hydrogenate a phenyl group thereof, and high activity to desulfurize 4-methyldibenzothiophene and 4,6-dimethyldibenzothiophene.

However, catalysts whose carriers contain phosphorous, boron or zeolite, have drawbacks in that their desulfurization activities for alkylbenzothiophenes and dibenzothiophenes without 4- or 6-alkyl substituent, such as dibenzothiophene, and 1-, 2- and 3-methyldibenzothiophene are inferior to those of conventional catalysts consisting essentially of cobalt and molybdenum on alumina carrier (F. van Looij et al. Applied Catalysis A: General 170, 1–12 (1998)). Moreover, said catalysts have further drawbacks in that, as they have Brønsted acid sites, they may easily cause a coloring of the product and when they are used for an olefin-containing feedstock oil or are used at a high temperature of 350° C. or higher, thiols and sulfides are occasionally generated to decrease the desulfurization ratio. In addition, they have another problem in that olefin elements in a feedstock may be polymerized at Brønsted acid sites to generate coke and the deactivation of catalyst may be accelerated. Even if an olefin is not included in a feedstock, if sulfur compounds are desulfurized with said catalyst, an olefin will be generated in situ, and it will cause an extraction of coke. This is understandable from the view that a coking speed, when thiophene flows into said catalyst, reaches ten times the coking speed when olefins or aromatic compounds flow into the catalyst (Catalysis Review, 24, (3), 343 (1982)).

It is difficult to desulfurize a diesel gas oil to 0.05 wt % or less as sulfur even if any above-mentioned catalyst is used, and studies have been carried out to deeply desulfurize it from an aspect of a process or reaction apparatus. For example, a process, comprising two different steps under different reaction conditions, which can deeply desulfurize a diesel gas oil without any worsening of hue is proposed in Japanese Unexamined Patent Publication (Kokai) No. 7-102266. A deep hydrodesulfurization process, where a diesel gas oil is separated by distillation into light fraction to be easily desulfurized and heavy fraction to be hardly desulfurized and then these fractions, after being individually hydrodesulfurized, are mixed again into a deep desulfurized diesel gas oil product, is proposed in Japanese Unexamined Patent Publication (Kokai) No. 5-311179. However, said deep hydrodesulfurization process comprising two different steps under different reaction conditions, which can deeply desulfurize a diesel gas oil without any worsening of hue, has an effect to improve a diesel gas oil hue but can hardly improve a further deep desulfurization. Said deep hydrodesulfurization process, where a diesel gas oil is separated by distillation into light fraction to be easily desulfurized and heavy fraction to be hardly desulfurized and then these fractions, after being individually hydrodesulfurized, are mixed into a deep desulfurized diesel gas oil product, has many problems in that a high reaction temperature and a high reaction pressure are needed for heavy fraction to be hardly desulfurized, and the like.

Thus, these prior arts have many problems and they do not achieve an effective production of excellent diesel gas oil with a low sulfur content when used for deep hydrodesulfurization of diesel gas oil as they are.

BRIEF SUMMARY OF THE INVENTION

It is an object of the present invention to provide a process, which can solve the above-mentioned conventional problem, for effectively producing a diesel gas oil product with an extremely low sulfur content, a good hue and excellent performances.

It is another object of the present invention to provide a process for producing the diesel gas oil by simple means without special equipment and any sever hydrodesulfurization conditions, such as high temperature and pressure, while the generation of coke can be inhibited and the catalyst activity can be prolonged.

After intensive researches for solving the above-mentioned problems, the present inventors have found a process for the deep desulfurization of sulfur-containing diesel gas oil, which comprises a specific combination of hydrogenation steps with specific catalysts in a specific amount, and have finally completed the present invention.

The present invention provides a process for the hydrodesulfurization of sulfur-containing diesel gas oil, comprising the steps of:

(1) The first step for hydrodesulfurizing a sulfur-containing diesel gas oil feedstock, (2) The second step for separating the hydrodesulfurized diesel gas oil feedstock into light fraction and heavy fraction by distillation, (3) The third step for hydrodesulfurizing further the separated heavy fraction and (4) The fourth step for mixing the further hydrodesulfurized heavy fraction and the separated light fraction into the diesel gas oil (diesel gas oil product).

DESCRIPTION OF THE PREFERRED EMBODIMENTS

In the process of the present invention said sulfur-containing diesel gas oil may preferably be hydrodesulfurized to 0.05 weight % of sulfur content or less in the first step.

In the process of the present invention a cut temperature for separating light fraction and heavy fraction in the second step is in a range of 300 to 350° C.

In addition, the process of the present invention may comprise a further step for hydrodesulfurizing the separated light fraction before the mixing in the fourth step.

Further, in the process of the present invention the hydrodesulfurization in the first step may be carried out using a catalyst which contains cobalt and molybdenum supported on a porous carrier containing alumina as a main ingredient and hydrodesulfurization in the entrance side part of the third step is carried out by a catalyst which contains nickel and molybdenum supported on a porous carrier containing 85 to 99 wt % of alumina and 15 to 1 wt % of zeolite, and hydrodesulfurization in the exit side part of the third step may be carried out using catalyst which contains cobalt or nickel and molybdenum supported on a porous carrier containing alumina as a main ingredient, where a catalyst volume of the entrance side part to total catalyst volume in the third step is in a range of 40 to 80 volume %.

The hydrogen gas flux used for hydrodesulfurization in the third step may preferably have a hydrogen purification ratio of 65 volume % or higher and a hydrogen sulfide content of 0.05 volume % or less.

Further, hydrodesulfurization conditions in the third step may be a temperature in a range of 320 to 360° C., a pressure in a range of 7 to 15 MPa, an LHSV (liquid hourly space velocity) in a range of 0.5 to 3 $h^{-1}$, and a hydrogen/oil ratio in a range of 1000 to 5000 scfb, and the diesel gas oil product obtained after the fourth step may have a sulfur content of 0.01 wt % or less and a Saybolt color of +20 or higher.

As for a pressure condition, a pressure in a range of 3 to 15 MPa may be adoptable. However a pressure in a range of 7 to 15 MPa may be necessary for keeping a sulfur content in the diesel gas oil product below 0.01 wt % or less and a Saybolt color of +20 or higher.

The inventions will be described in detail by illustrating the embodiments and the effects thereof. The present inventors have studied the above-mentioned problems in the conventional techniques, researched and testified various methods, components of the systems, etc. As a result, they found that one of the most important key points for effective production of desulfurized diesel gas oil with desired excellent properties was to achieve nearly complete hydrodesulfurization of alkylbenzothiophenes and dibenzothiophenes with no alkyl group on 4- or 6-positions among sulfur-containing compounds in the sulfur-containing diesel gas oil feedstock, prior to other steps and that, by doing so, an expensive catalyst or severe hydrodesulfurization conditions would not be necessarily demanded in the following steps. Especially, if the sulfur-containing diesel gas oil were desulfurized in the first step to lessen the sulfur content to 0.05 wt % or less, the desulfurization ratios of alkylbenzothiophenes and dibenzothiophenes with no alkyl group on 4- or 6-positions could become 99 wt % or higher. Therefore, this process can demonstrate the effect of the present invention to a maximum.

A catalyst for the first step can be a catalyst wherein one or more carrier components may be selected from the group of porous inorganic materials such as silica, alumina, magnesia, titania, silica-alumina, alumina-zirconia, alumina-titania, alumina-boria, alumina-chromia, silica-alumina-magnesia, silica-alumina-zirconia, and its active metal component may be selected from the group of the metals of GROUP VIII, comprising cobalt, nickel, iron, rhodium, palladium, platinum etc, and of GROUP VI comprising molybdenum, tungsten, chromium and others or a combination thereof. By the process of the present invention, well-known hydrodesulfurization catalysts as well, that is to say, for example a catalyst where cobalt and/or nickel and molybdenum or tungsten are supported on the porous carrier, instead of expensive or specific catalysts may be used effectively. Preferably it is advantageous to use catalysts where cobalt and molybdenum are supported on a porous carrier containing alumina as a main ingredient (said carrier may contain almina of 95 to 100 wt % as a main ingredient and other ingredient of up to 5 wt %, such as phosphorus, magnesium, and calcium), because said catalysts show higher desulfurization efficiency to alkylbenzothiophenes and dibenzothiophenes with no alkyl group on 4- or 6-site than the other catalysts. Additionally, said catalysts are the most excellent, because they can also desulfurize 90 wt % or more of 4-methyidibenzothiophene and 4,6-dimethyldibenzothiophene, which are difficult to be desulfurized, though the activity of desulfurization for them is not so high. Hydrogen without hydrogen sulfide as well may be effective as a hydrogen flux for desulfurization in the first step. But hydrogen sulfide-containing hydrogen flux recovered from the exit of the third step or hydrogen sulfide-containing hydrogen flux recovered from the exit of the further step for hydrodesulfurization of light fraction after the third step may be used as the hydrogen flux for hydrodesulfurization in the first step. These selections should be done on consideration of properties for the aimed diesel gas oil and the hydrodesulfurization conditions etc.

Diesel gas oil feedstock desulfurized in the first step is to be separated into light fraction and heavy fraction by distillation in the second step. A cut point temperature for separation of the light fraction and the heavy fraction by distillation may be preferably in a range of 300 to 350° C., most preferably in a range of 320 to 340° C. This is because, when a diesel gas oil will be cut by distillation at a temperature in a range of 320 to 340° C., sulfur-containing compounds (boiling point: in a range of 320 to 340° C.) such as 4-methyldibenzothiophene and dibenzothiophene (b. p.: 333° C.) to be hardly desulfurized, will be separated into the heavy fraction from the light fraction and the desulfurization of the heavy fraction will be carried out effectively by a desulfurization step suitable for the heavy fraction. A conventional normal pressure multi-step-type-continuous distillation arrangement may be used for said distillation. The hydrogen flux recovered from the exit of the first step, after hydrogen sulfides being removed from the hydrogen flux by an amine absorption arrangement, will be passed into the third step or the further hydrodesulfurization step for light fraction after the third step.

As the light fraction separated by distillation scarcely contains sulfur, it can be used as itself as a deep desulfurized diesel gas oil. On the other hand, the heavy fraction must be hydrodesulfurized further in the third step, because it still contains sulfur compounds in a range of 0.01 to 0.1 wt %. A conventional desulfurization catalyst as well may be used as a catalyst in the third step. However, it is desirable to use a catalyst with high revitalization of desulfurization for 4-methyldibenzothiophene and 4,6-dimethyldibenzothiophene. For instance, although a catalyst, whose carrier contains phosphorus and boron, can be used, it has a drawback to easily cause a coloring etc. A catalyst containing nickel and molybdenum supported on a porous carrier, that contains 85 to 99 wt % alumina and 15 to 1 wt % zeolite, may be used preferably from the viewpoint that such drawbacks are comparatively few and a procurement thereof is easy. More desirable ratio of alumina/zeolite is in a range of 90 to 97 wt %/10 to 3 wt %, judging from the effect of desulfurization for the above-mentioned compounds. However, this catalyst as well generates thiols, sulfides, and colored items as byproducts.

A variety of ways have been examined to solve the above-mentioned problems, and it was revealed that a diesel gas oil product with a less sulfur content and an excellent hue could be obtained by using such catalyst that 40 to 80 volume % of the total catalyst volume filled in the entrance side part of step (c) comprised nickel and molybdenum supported on a porous carrier comprising alumina of 85 to 99 wt % and zeolite of 15 to 1 wt %, and the rest of catalysts filled in the exit part of step (c) comprised cobalt or nickel and molybdenum supported on a porous carrier containing alumina as a main ingredient. Because, this way, the by-products generated by the zeolite contained in the catalyst in the entrance side part of the third step (c), such as thiols and sulfides and colored items as well, will be hydrogenated by the following catalyst. Moreover, other catalysts may be filled into the middle part between the entrance side part and the exit side part.

In the third step (c), it is preferable that a hydrogen purity of a hydrogen gas flux is 65 volume % and higher, and a hydrogen sulfide concentration is 0.05 volume % and less. Furthermore, it is more preferable that in said hydrogen, purity is 70 volume % and higher, and the hydrogen sulfide concentration is 0.01 volume % and less. In the latter case, the effect of desulfurization for the heavy fraction can be improved. This is due not only to the prevention of the obstruction of desulfurization, which will be caused by the adsorption of hydrogen sulfides to the catalytic activity point, but also to the maximum reduction of the by-production of thiols and sulfides. As for the hydrogen, unused hydrogen without hydrogen sulfides manufactured from a hydrogen manufacturing arrangement or a gasoline reforming arrangement can be used. Hydrogen, which is obtained by removing hydrogen sulfides from hydrogen containing flux recovered from the exit of the third step (c) by amine absorption arrangement, can be used as well.

Moreover, a more improved excellent diesel gas oil product with less sulfur content can be obtained by using the further step, installed before the mixing of the fourth step (d), where the light fraction separated by distillation in the first step (a) is further hydrodesulfurized.

The heavy fraction sufficiently desulfurized this way to a lower sulfur content level can be mixed with the light fraction to be the diesel gas oil product. A mixing ratio of the heavy fraction and the light fraction in the fourth step (d) may be the same ratio as they were cut in the first step (a). It is also possible to adjust properties of the product by changing the mixing ratio if necessary. It is also possible to make the diesel gas oil product by mixing further the diesel gas oil product by the present invention with the diesel gas oil manufactured from other desulfurization arrangement. It is natural to be able to mix a lubricant improver, a cetane number improver, and a desiccating agent into a diesel gas oil product if necessary.

An active metal content contained in a conventional desulfurization catalyst for a usual diesel gas oil can be adopted as an active metal content for the present invention. That is, Co or Ni active metal (calculated as CoO or NiO) may be in a range of 1 to 10 weight parts, based on 100 weight parts of a carrier (including a weight of zeolite), preferably in a range of 3 to 6 weight parts. And Mo active metal (calculated as $MoO_3$) may be in a range of 10 to 30 weight parts, based on 100 weight parts of a carrier, preferably in a range of 15 to 25 weight parts. As for a metal content, when it is low, as the metal activity will be insufficient, the deactivation kinetics of the catalyst will grow. On the other hand, if too much, as the metal activity will saturate, it will be uneconomical.

In the third step (c) of the present invention, it is preferable to use a catalyst, where nickel and molybdenum are supported on a carrier which contains 85 to 99 wt % of alumina and 15 to 1 wt % of zeolite, as a part of the catalyst in the third step (c). In this case, A-type zeolite, X-type zeolite, Y-type zeolite, L-type zeolite, MFI-type zeolite, mordenite, etc. may be used as the zeolite. Above all, USY-type zeolite made by dealuminating Y-type zeolite to improve the heat stability may be used most desirably. These zeolites may be ion-exchanged to generate Brønsted acid sites, and they may be ion-exchanged as well by protons, an alkaline earth metal, rare earth metal etc.

The zeolite can be followed by calcination, after being molded, by being mixed with a gel of alumina, and can be put on a molded alumina carrier with a binder.

A catalyst added with a small amount of various reforming elements for improvement of the desulfurization activity etc. is not be hindered to be used as a catalyst in each hydrogenation zone. For instance, it is possibly effective to add phosphorous especially to the catalyst in the entrance side part of the third step (c), because it can improve the dispersibility of active metals and increase the Brønsted acid sites to improve the desulfurization activity to 4-methyldibenzothiophene and 4,6-dibenzothiophene. However, in that case, it is necessary to consider the drawbacks therefrom, such as product's coloring etc. On the other hand, it is possibly effective to add potassium or magnesium to a catalyst in the exit side part of third hydrogenation step, because it can decrease the Brønsted acid sites and regulate the generation of thiols and sulfides.

A sulfur-containing petroleum diesel gas oil feedstock applicable to the present invention is a diesel gas oil fraction of the crude oil (the boiling point: in a range of 200 to 380° C.) such as a straight run diesel gas oil, a catalytic cracking diesel gas oil, and a pyrolysis diesel gas oil. The process according to the preset inventions may be effectively used for the vacuum gas oil with higher boiling point.

A permissible sulfur content contained in the diesel gas oil feedstock applicable to the present invention is not especially limited, and the sulfur content in usual straight-run diesel gas oil is about 1 to 2 wt %. The sulfur content in the diesel gas oil product can be decided arbitrarily if necessary, and a necessary desulfurization ratio can be achieved by the optimization of reactive conditions of reaction temperature, pressure, and liquid hourly space velocity (LHSV), etc.

A diesel gas oil product, that is the diesel gas oil, desulfurized by the present invention can be used as a regular or a premium diesel fuel for diesel gas oil car (diesel car). Moreover it may be used a diesel fuel by mixed with an A-type heavy oil.

Hydrodesulfurization conditions for a usual diesel gas oil can be adopted as hydrodesulfurization conditions for the hydrodesulfurization process in the first step (a) and the third step (c), and for the hydrodesulfurization process for a light fraction just before the mixing process in the fourth step (d) of the present inventions. That is, appropriate conditions can be set in a range of 320 to 380° C. in temperature, in a range of 3 to 15 MPa in pressure, in a range of 0.5 to 3 $h^{-1}$ in LHSV, and in a range of 1000 to 5000 scfb in hydrogen/oil ratio according to the target desulfurization ratio. The possibility of achievement of a high desulfurization ratio, even in case of adopting the usual desulfurization conditions, is one of main characteristics of the present inventions. As for pressure among these conditions, a relatively low pressure of 3 to 7 MPa may be applicable, in almost all cases, as the reaction pressure for hydrodesulfurization in the first step (a) and in the further step for light fraction just before the mixing process of the fourth step (d). When the reaction pressure for hydrodesulfurization process in the third step (c) is set in a range of 7 to 15 MPa, more preferably of 10 MPa or higher instead, a high desulfurization ratio can be achieved. Moreover, when a reaction temperature in the third step (c) is kept to 360° C. or lower, the hue of obtained product also becomes excellent. According to the preset inventions, so called super-deep-desulfurized diesel gas oil product, whose sulfur content is 0.01 wt % or less, can be manufactured due to the existence of the third step (c).

A reactor used for the present invention may be a reactor of any type known so far. For instance, both of fixed bed type reactor and moving bed type reactor or both of down flow type reactor and improvement flow type reactor may be acceptable. The most suitable among them is a fixed bed down flow type reactor because this is a reactor type used to desulfurize the diesel gas oil so far, and conventional arrangements can be used as they are. A single reactor, wherein the reactor bed is divided into plural catalyst beds, may be generally applicable therefor. Each process of the first to the fourth steps generally has a single reactor. Each process may be reacted in an arrangement that has plural reactors in parallel or in series. It is preferable to set up the distributor above each catalyst bed, which can uniformly distribute a liquid, because the circumstance in the reactor will become a so-called trickle bed circumstance where a liquid coexists with a gas in case of under the conditions for deep desulfurization. Moreover, a quenching hydrogen gas may be introduced into the best location according to the heat situation and the heat can be controlled thereby. Hydrogen, after the hydrogen sulfides therein are removed by absorption in amine solution, can be used by recycling. In an actual arrangement, a molded catalyst may be used, and the catalyst may be loaded in sock or dense in the reactor by a conventional way. After said catalyst is presulfided in situ, the heated diesel gas oil with hydrogen can flow into the reactor loaded with the catalyst. A used catalyst may be repeatedly used after a usual baking reproduction process.

The present will be further illustrated below by means of non-limitative examples.

EXAMPLE 1

300 ml of a catalyst, where 5 weight parts of cobalt (based on Coo) and 20 weight parts of molybdenum (based on $MoO_3$) were supported on a γ-alumina carrier of 100 weight parts, was filled in a 1 inch inside diameter reaction tube.

After this catalyst was presulfided by straight run kerosene containing dimethyldisulphide (sulfur content of 3 wt %) under conditions of 300° C., 5 MPa, LHSV 1 $h^{-1}$, and 1000 scfb in hydrogen/oil ratio for 4 hours, Middle East straight run diesel gas oil feedstock (boiling point: in a range of 230 to 360° C., sulfur content; 1.30 wt %) was passed into said catalyst to be desulfurized under conditions of 340° C. in temperature, 5 MPa in pressure, LHSV 1 $h^{-1}$, and 1000 scfb in hydrogen/oil ratio. The sulfur content of desulfurized oil after the first step (a) was 0.048 wt %.

The desulfurized oil was separated into light fraction of 62 volume % and heavy fraction of 38 volume % by an atmospheric distillation arrangement having 20 theoretical plates at a cut temperature of 330° C. in the second step (b). The sulfur content of the light fraction was 0.007 wt % and that of the heavy fraction was 0.12 wt %.

In addition, 200 ml of catalyst, where 3 weight parts of nickel (based on NiO) and 20 weight parts of molybdenum (based on $MoO_3$) were supported on a carrier containing 97 wt % of γ-alumina and 3 wt % of proton exchangeable USY type zeolite, was filled into an upstream part (in the entrance side part) of a 1 inch inside diameter reaction tube of the third step (c) and 100 ml of catalyst, where 5 weight parts of cobalt (based on CcO) and 20 weight parts of molybdenum (based on $MoO_3$) were supported on a γ-alumina carrier, was filled into a downstream part (in the exit side part) of said reaction tube. After these catalysts were presulfided by straight run kerosene containing dimethyldisulphides (sulfur content; 3 wt %) under condition of 300° C., 10 MPa, LHSV 1 $h^{-1}$, and 1000 scfb in hydrogen/oil ratio for 4 hours, the above-mentioned desulfurized heavy fraction was passed into said catalysts under conditions of 340° C. in temperature, 10 MPa in pressure, LHSV 1 $h^{-1}$ and 2000 scfb in hydrogen/oil ratio to be further desulfurized. The sulfur content of further desulfurized heavy fraction was 0.013 wt %.

The further desulfurized heavy fraction was mixed with above-mentioned separated light fraction to produce a diesel gas oil product having a sulfur content of 0.009 wt % and a Saybolt color (JISK-2580) of +21.

EXAMPLE 3

80 volume % of Middle East straight run diesel gas oil (boiling point; 224 to 368° C., sulfur content; 1.41 wt %), 10 volume % of catalytic cracking diesel gas oil (boiling point; 212 to 345° C., sulfur content; 0.23 wt %), and 10 volume % of diesel gas oil from residual desulfurization unit (boiling point; 181 to 346° C., sulfur content; 0.08 wt %) were mixed together.

Said mixed diesel gas oil feedstock was passed into and desulfurized in a reactor of the first step (a), where the same catalyst at the same amount as used in the first step (a) of Example 1 was filled in, under conditions of 350° C., 3 MPa, LHSV 2 $h^{-2}$, and hydrogen/oil ratio 1000 scfb. The sulfur content of said desulfurized diesel gas oil was 0.13 wt %.

The desulfurized diesel gas oil feedstock was separated into light fraction of 51 wt % and heavy fraction of 49 wt % by a true boiling point distillation apparatus (ASTM D-2892) used in the second step at a cut temperature of 320° C. The sulfur content of light fraction was 0.01 wt %, and that of heavy fraction was 0.25 wt %.

In addition, 200 ml of a catalyst, where nickel of 4 weight parts (based on NiO) and molybdenum of 20 weight parts (based on $MoO_3$) were supported on a carrier containing 90 wt % of amorphous silica-alumina and 10 wt % of proton exchangeable USY type zeolite, was filled into an upstream part of a 1 inch inside diameter reaction tube, and 100 ml of a catalyst, where cobalt of 5 weight parts (based on CoO) and molybdenum of 20 weight parts (based on $MoO_3$) were supported on a γ-alumina carrier, was filled into a downstream part of said reaction tube. After the catalyst was presulfided with a straight run kerosene of a sulfur content of 3 wt % including dimethyldisulphides under conditions of 300° C., 10 MPa, LHSV 1 $h^{-1}$, 1000 scfb in hydrogen/oil ratio for 4 hours, above-mentioned desulfurized heavy fraction was passed into and further desulfurized under conditions of 360° C., 10 MPa, LHSV 1 $h^{-1}$, and 2000 scfb in hydrogen/oil ratio. The sulfur content of further desulfurized heavy fraction is 0.009 wt %.

Moreover, 300 ml of a catalyst, where cobalt of 5 weight parts (based on CoO) and molybdenum of 20 weight parts (based on $MoO_3$) were supported on a γ-alumina carrier of 100 weight parts, was filled into a 1 inch inside diameter reaction tube of hydrodesulfurization step for light fraction installed before a mixing process of the fourth step (d). After said catalyst was presulfided with a straight run kerosene containing dimethyldisulphides (sulfur content; 3 wt %) under conditions of 300° C., 3 MPa, LHSV 1 $h^{-1}$, 1000 scfb in hydrogen/oil ratio for 4 hours, the above-mentioned desulfurized light fraction was passed into and further desulfurized under conditions of 320° C., 3 MPa, LHSV 1 $h^{-1}$ and 1000 scfb in hydrogen/oil ratio. The sulfur content of generated light fraction was 0.001 wt %.

Said generated light fraction (further desulfurized light fraction) was mixed with said heavy fraction (further desulfurized heavy fraction), and was produced as the diesel gas oil product with a sulfur content of 0.005 wt % and a Saybolt color of +20.

EXAMPLE 4

The same method, as used in Example 3, was adopted in Example 4, except that only an LHSV condition among said conditions used in the third step (c) of Example 3 was changed from 1 $h^{-1}$ to 0.5 $h^{-1}$. Heavy fraction separated in the second step (b) of Example 3 was desulfurized by the same process as used in Example 3 with an LHSV of 0.5 $h^{-1}$ as above-mentioned. The sulfur content of said desulfurized heavy fraction was 0.005 wt %. The further desulfurized heavy fraction was mixed with light fraction further desulfurized by the same further desulfurization process for light fraction as that of Example 3. The diesel gas oil product with a sulfur content of 0.003 wt % and a Saybolt color of +20 was produced.

COMPARATIVE EXAMPLE 1

600 ml of catalyst, where nickel of 3 weight parts (calculated as NiO) and molybdenum of 20 weight parts (calculated as $MoO_3$) were supported on a carrier containing a γ-alumina of 97 wt % and a proton exchangeable USY type zeolite of 3 wt %, was filled into the same reaction tube as used in example 1.

After said catalyst was presulfided by a straight run kerosene containing dimethyldisulphides (sulfur content; 3 wt %) under conditions of 300° C., 5 MPa, LHSV 1 $h^{-1}$, 1000 scfb in hydrogen/oil ratio for 4 hours, the same light fraction as used in Example 1 was passed and desulfurized under conditions of 340° C. in temperature, 5 MPa in pressure, LHSV 0.5 $h^{-1}$, and 2000 scfb in hydrogen/oil ratio. The generated oil had a sulfur content of 0.024 wt % and a Saybolt color of −10.

COMPARATIVE EXAMPLE 2

600 ml of catalyst, where cobalt of 5 weight parts (calculated as CoO) and molybdenum of 20 weight parts (calculated as $MoO_3$) were supported on a γ-alumina carrier of 100 weight parts, was filled into the same reaction tube as used in Example 1. After said catalyst was presulfided by the same way as used in Comparative example 1, the same diesel gas oil feedstock used in Example 1 was passed into and desulfurized under the same conditions as used in Comparative Example 1. The generated oil had a sulfur content of 0.029 wt % and a Saybolt color of +15.

COMPARATIVE EXAMPLE 3

The mixed diesel gas oil feedstock used in Example 3 was passed and hydrodesulfurized by the same catalyst as used in Comparative example 1. Reaction conditions were 360° C., 10 MPa, LHSV 0.5 $h^{-1}$ and 2000 scfb in hydrogen/oil ratio. The generation oil had a sulfur content of 0.008 wt % and a Saybolt color of −5.

According to the present inventions for hydrodesulfurization of diesel gas oil, a deep desulfurization can be achieved by a simple way, without necessitating sever processing conditions of temperature and pressure etc, and a specific catalyst, equipment assembly and arrangement. The present inventions can regulate an extraction of coke, prolong the catalyst activity, and produce a diesel gas oil product with a low sulfur extent and an excellent hue.

What is clamed is:

1. A process for hydrodesulfurization of sulfur-containing petroleum hydrocarbon diesel gas oil comprising the steps of:

The first step (a); hydrodesulfurizing a sulfur-containing petroleum hydrocarbon diesel gas oil by use of a hydrodesulfurization catalyst so that the sulfur content of the oil becomes 0.05 wt % or less, The second step (b); separating the hydrodesulfurized diesel gas oil feedstock into light fraction and heavy fraction by distillation at a cut point temperature in a range of 320 to 340° C., The third step (c); hydrodesulfurizing further the separated heavy fraction through a hydrodesulfurization zone for third step comprising an entrance side part and exit side part thereof, wherein the hydrodesulfurization conditions are a temperature in a range of 320 to 360° C., a pressure in a range of 7 to 15 MPa, a LHSV in a range of 0.5 to 3 $h^{-1}$ and a hydrogen/oil ratio in a range of 1000 to 5000 scfb, and The fourth step (d); mixing the further hydrodesulfurized heavy fraction and the separated light fraction into the diesel gas oil having a sulfur content of 0.01 wt % or less and a Saybolt color of +20 or higher.

2. A process according to claim 1, wherein the process comprises a further step (e) to further hydrodesulfurize the separated light fraction before the mixing in the fourth step (d).

3. A process according to claim 1, wherein the hydrodesulfurization in the first step (a) is carried out by a catalyst consisting essentially of cobalt and molybdenum supported on a porous carrier containing alumina as a main ingredient, the hydrodesulfurization of the separated heavy fraction in the entrance side part of the third step (c) is carried out by a catalyst consisting essentially of nickel and molybdenum supported on a porous carrier containing 85 to 99 wt % of alumina and 15 to 1 wt % of zeolite, and the hydrodesulfurization of the separated heavy fraction in the exit side part of the third step (c) is carried out by a catalyst consisting essentially of cobalt or nickel and molybdenum supported on a porous carrier containing alumina as a main ingredient, and a volume ratio of the catalyst in the entrance side part to the total catalyst of the third step (c) is in a range of 40 to 80 volume %.

4. A process according to claim 3, wherein the porous carrier in the entrance side part of the third step has an alumina/zeolite ratio in a range of 90 to 97 wt % 10 to 3 wt %.

5. A process according to claim 1, wherein a hydrogen purity of hydrogen gas flux used for the hydrodesulfurization in the third step is 65 volume % or higher, and a hydrogen sulfide concentration in the hydrogen gas flux is 0.05 volume % or less.

6. A process according to claim 1, wherein one or more active metal components of hydrodesulfurization catalyst in the first step are selected from the group consisting of the metals of GROUP VIII comprising cobalt, nickel, iron, rhodium, palladium, platinum and of GROUP VI comprising molybdenum, tungsten, chromium and a combination thereof, and one or more carrier components of the hydrodesulfurization catalyst are selected from the group consisting of porous inorganic materials of silica, alumina, magnesia, titania, silica-alumina, alumina-zirconia, alumina-titania, alumina-boria, alumina-chromia, silica-alumina-magnesia, silica-alumina-zirconia.

7. A process according to claim 1, wherein a hydrodesulfurization catalyst in the first step contains cobalt and/or nickel and molybdenum or tungsten supported on the porous carrier containing alumina of 95 to 100 wt % and one or more other ingredients selected from phosphorus, magnesium, and calcium up to 5 wt %.

8. A process according to claim 2, wherein a hydrogen flux for desulfurization in the first step is a hydrogen flux without hydrogen sulfide, a hydrogen sulfide-containing hydrogen flux recovered from the exit of the third step or a hydrogen sulfide-containing hydrogen flux recovered from the exit of the further step for hydrodesulfurization of light fraction after the third step.

9. A process according to claim 2, wherein a hydrogen sulfide-containing hydrogen flux from the exit of the first step is used after removal of hydrogen sulfides by amine absorption for desulfurization in the third step or the further hydrodesulfurization step of light fraction after the third step.

10. A process according to claim 3, wherein in the first step an amount of Co (as CoO) is in a range of 1 to 10 wt parts and an amount of Mo (as $MoO_3$) is in a range of 10 to 30 wt parts based on 100 wt parts of carrier, in the entrance side part of the third step an amount of Ni (as NiO) is in a range of 1 to 10 wt parts and Mo (as $MoO_3$) is in a range of 10 to 30 wt parts based on 100 wt parts of carrier, and in the exit side part of the third step an amount of Co (as CoO) and an amount of Ni (as NiO) are independently in a range of 1 of 10 wt parts and an amount of Mo (as $MoO_3$) is in a range of 10 of 30 wt parts based on 100 wt parts of carrier.

11. A process according to claim 1, wherein a reactor for hydrodesulfurization is selected from a combination of a fixed bed reactor or a moving bed reactor and a down flow reactor or an improvement flow reactor.

12. A process according to claim 3, wherein the zeolite in the entrance side part of the third step (c) is selected from a group of USY zeolite, A zeolite, X zeolite, Y zeolite, L zeolite, MFI zeolite and mordenite.

13. A process according to claim 2, wherein the hydrodesulfurization conditions in the first step (a), and the further hydrodesulfurization step (e) are a temperature in a range of 320 to 360° C., a pressure in a range of 3 to 15 MPa, a LHSV in a range of 0.5 to 3 $h^{-1}$ and a hydrogen/oil ratio in a range of 1000 to 5000 scfb.

* * * * *